US005821698A

United States Patent [19]

Lapatovich

[11] Patent Number: 5,821,698

[45] Date of Patent: Oct. 13, 1998

[54] REFRACTORY BLOCK FOR SUPPORTING ELECTRODELESS LAMP CAPSULE

[75] Inventor: Walter P. Lapatovich, Boxford, Mass.

[73] Assignee: Osram Sylvania Inc., Danvers, Mass.

[21] Appl. No.: 670,870

[22] Filed: Jun. 26, 1996

[51] Int. Cl.[6] ..... H05R 41/16

[52] U.S. Cl. ..... 315/248; 315/39; 315/344; 362/263; 313/318.01

[58] Field of Search ..... 315/248, 344, 315/39; 313/634, 289, 292, 256, 318.01; 362/307, 311, 310, 263

[56] References Cited

U.S. PATENT DOCUMENTS

| | | | |
|---|---|---|---|
| 2,488,169 | 11/1949 | Browner | 315/248 |
| 5,070,277 | 12/1991 | Lapatovich | 315/248 |
| 5,113,121 | 5/1992 | Lapatovich et al. | 315/248 |
| 5,130,612 | 7/1992 | Lapatovich et al. | 315/248 |
| 5,144,206 | 9/1992 | Butler et al. | 315/248 |
| 5,241,246 | 8/1993 | Lapatovich et al. | 315/248 |

*Primary Examiner*—Arnold Kinkead
*Attorney, Agent, or Firm*—Carlo S. Bessone

[57] ABSTRACT

An electrodeless lamp assembly includes an electrodeless lamp capsule, a substrate having top and bottom surfaces and an edge, an applicator for coupling electrical energy to the lamp capsule and a refractory support block. The support block includes a top wall having a recess and a side wall having a groove. The lamp capsule is affixed in the recess, and the edge of the substrate is secured in the groove. The lamp capsule is supported above the substrate by the support block. During assembly, the support block may be moved along the edge of the substrate, and the lamp capsule may be moved with respect to the support block to adjust the position of the lamp capsule.

18 Claims, 2 Drawing Sheets

REFRACTORY BLOCK FOR SUPPORTING ELECTRODELESS LAMP CAPSULE

FIELD OF THE INVENTION

This invention relates to electrodeless high intensity discharge lamps and, more particularly, to a refractory block for supporting an electrodeless lamp capsule above a substrate in an electrodeless high intensity discharge lamp.

BACKGROUND OF THE INVENTION

Electrodeless high intensity discharge (HID) lamps have been described extensively in the prior art. In general, electrodeless HID lamps include an electrodeless lamp capsule containing a volatilizable fill material and a starting gas. The lamp capsule is mounted in a fixture which is designed for coupling high frequency power to the lamp capsule. The high frequency power produces a light-emitting plasma discharge within the lamp capsule. Recent advances in the application of microwave power to lamp capsules operating in the tens of watts range are disclosed in U.S. Pat. No. 5,070,277, issued Dec. 3, 1991, to Lapatovich; U.S. Pat. No. 5,113,121, issued May 12, 1992, to Lapatovich, et al.; U.S. Pat. No. 5,130,612, issued Jul. 14, 1992, to Lapatovich et al.; U.S. Pat. No. 5,144,206, issued Sep. 1, 1992, to Butler et al.; and U.S. Pat. No. 5,241,246, issued Aug. 31, 1993, to Lapatovich, et al. As a result, compact electrodeless HID lamps and associated applicators have become practical.

The above patents disclose small, cylindrical lamp capsules wherein high frequency energy is coupled to opposite ends of the lamp capsule with a 180° phase shift. The applied electric field is generally colinear with the axis of the lamp capsule and produces a substantially linear discharge within the lamp capsule. The fixture for coupling high frequency energy to the lamp capsule typically includes a planar transmission line, such as a microstrip transmission line, with electric field applicators, such as helices, cups or loops, positioned at opposite ends of the lamp capsule. The microstrip transmission line couples high frequency power to the electric field applicators with a 180° phase shift. The lamp capsule is typically positioned in a gap in the substrate of the microstrip transmission line and is spaced above the plane of the substrate by a few millimeters, so that the axis of the lamp capsule is colinear with the axes of the field applicators.

The lamp capsule may be positioned relative to the field applicators by dielectric V-blocks, as disclosed in the aforementioned U.S. Pat. Nos. 5,070,277 and 5,113,121. In the prior art electrodeless lamps, the lamp capsule is cemented to the V-block, and the V-block is cemented to the surface of the microstrip transmission line. The positioning of the V-block on the transmission line is imprecise, since it floats on a pad of adhesive. Furthermore, the V-block may interfere with the operation of the transmission line if it is located on or near a conductor of the transmission line. The size and geometry of the lamp assembly may not permit the V-block to be located so as to avoid interference with operation of the transmission line.

SUMMARY OF THE INVENTION

According to the present invention, an electrodeless lamp assembly is provided. The lamp assembly comprises an electrodeless lamp capsule, a substrate having top and bottom surfaces and an edge, an applicator for coupling electrical energy to the lamp capsule, and a refractory support block. The support block includes a top wall having a recess and a side wall having a groove. The lamp capsule is affixed in the recess, and the edge of the substrate is secured in the groove. The lamp capsule is supported above the substrate by the support block.

The support block preferably comprises a rectangular parallelepiped. The recess in the top wall may comprise a V-shaped notch or a semicircular notch. In one embodiment, the longitudinal axis of the recess is perpendicular to the longitudinal axis of the groove. The support block is preferably fabricated of a heat-resistant, nonmetallic material.

According to another aspect of the invention, a refractory block for supporting a lamp capsule above a substrate is provided. The refractory block comprises a parallelepiped fabricated of a refractory material and having a top wall and plural side walls. The top wall has a recess for receiving the lamp capsule, and one of the side walls has a groove for receiving an edge of the substrate.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
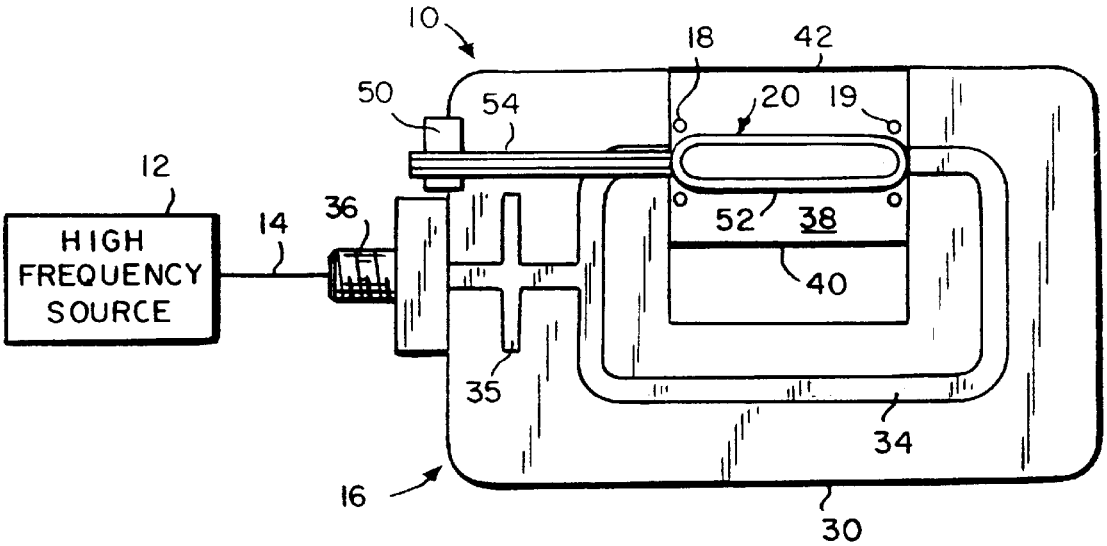
FIG. 1 is a schematic representation of a first embodiment of an electrodeless, high-intensity discharge lamp system in accordance with the present invention.

An example of an electrodeless, high-intensity discharge lamp system in accordance with the invention is shown in FIG. 1. The lamp system includes an electrodeless lamp assembly 10 and a high frequency source 12. High frequency power from the source 12 is coupled to the electrodeless lamp assembly 10 through a transmission line 14, which may for example be a coaxial cable. The electrodeless lamp assembly 10 includes a planar transmission line 16, electric field applicators 18 and 19, and a lamp capsule 20 having an enclosed volume containing a lamp fill material. The lamp capsule 20 contains a mixture of starting gas and chemical dopant material that is excitable by high frequency power to a state of luminous emission.

The planar transmission line 16 includes a substrate 30 having a patterned conductor 34 coupled to a high frequency connector 36. The connector 36 is coupled via transmission line 14 to high frequency source 12. The conductor 34 interconnects the connector 36 and the electric field applicators 18 and 19. The conductor 34 is designed to provide a phase shift of 180° between applicators 18 and 19 at the frequency of source 12 and may including a tuning stub 35. The opposite surface of substrate 30 is covered with a conductive ground plane (not shown in FIG. 1). The substrate 30 is provided with a gap 38 in which the lamp capsule 20 is mounted. The lamp capsule 20 is spaced above the plane of substrate 30 and is aligned with the electric field applicators 18 and 19. Electrically conductive wires 40 and 42 may be connected between opposite sides of gap 38 to symmetrize the electric field in the region of lamp capsule 20.

The lamp capsule 20 is mechanically supported above the surface of substrate 30 by a refractory support block 50. Lamp capsule 20 includes a discharge portion 52 and a lamp stem 54 that extends from one end of the discharge portion 52. The lamp stem 54 is cemented to support block 50, so that the lamp capsule 20 is spaced above substrate 30 in alignment with electric field applicators 18 and 19.

Figure 2:
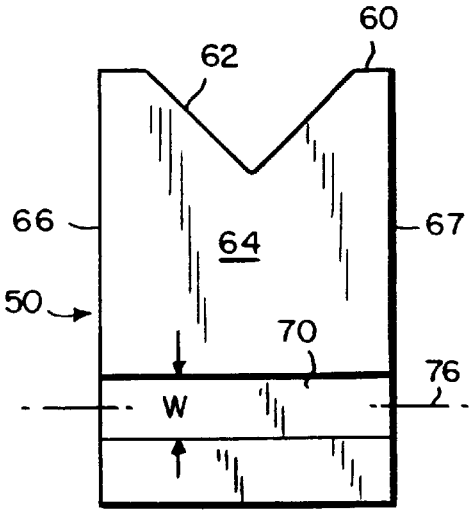
FIG. 2 is a front elevation view of a first embodiment of a refractory support block in accordance with the present invention.
Figure 3:
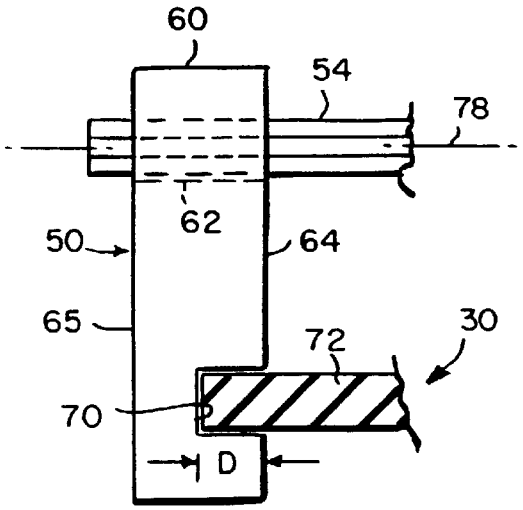
FIG. 3 is a partial cross-sectional view of the lamp assembly of FIG. 1, showing the refractory support block.

Details of the support block 50 are shown in FIGS. 2 and 3. The support block 50 is fabricated of a refractory material and may have the general form of a rectangular parallelepiped. The support block 50 includes a top surface 60 having a groove 62 and side walls 64, 65, 66 and 67. A groove 70 is formed in side wall 64. The groove 70 is dimensioned and shaped for receiving an edge 72 of substrate 30. The recess 62 is dimensioned and shaped for receiving lamp stem 54. In the finished lamp assembly, edge 72 of substrate 30 is positioned in groove 70 and is cemented in position. As noted above, the lamp stem 54 is cemented in recess 62 to form a rigid assembly. During manufacturing, the support block 50 may be moved along the edge 72 of substrate 30 in a direction parallel to a longitudinal axis 76 of groove 70. In addition, lamp stem 54 may be moved parallel to a longitudinal axis 78 of recess 62 with respect to support block 50. This construction permits the position of the lamp capsule 20 to be adjusted before it is cemented into a fixed position.

Figure 4:
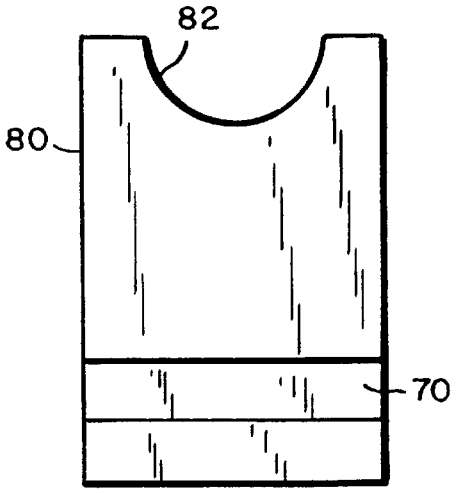
FIG. 4 is a front elevation view of a second embodiment of the refractory support block in accordance with the present invention.

In the embodiment of FIGS. 2 and 3, the longitudinal axis 76 of groove 70 is perpendicular to the longitudinal axis 78 of recess 62. It will be understood that at different configurations of the refractory support block 50 are included within the scope of the present invention. For example, the longitudinal axis of the groove 70 may be parallel to the longitudinal axis of recess 62. In this configuration, groove 70 may be formed in one of the side walls 66 or 67. The relative positions of the recess 62 and groove 70 depend on the configuration of the substrate and the desired mounting position of lamp capsule 20. The spacing between groove 70 and recess 62 defines the spacing of lamp capsule 20 above substrate 30. The recess 62 may have any desired shape. In the example of FIG. 2, recess 62 is formed as a V-shaped notch. Another embodiment of the refractory support block is shown in FIG. 4. A refractory support block 80 includes a recess 82 formed as a semicircular notch. The groove 70 has width W that is slightly larger than the thickness of substrate 30 and a depth D that is sufficient to permit secure attachment of the support block 50 to the edge 72 of substrate 30. The support block 50 is typically utilized with a planar substrate 30. However, the support block of the invention may be utilized with a substrate of any shape. The groove 70 is shaped to match the contour of substrate 30. For example, if the substrate has a radius of curvature, the groove 70 is provided with a matching radius of curvature.

The support block of the present invention is fabricated of a heat-resistant, electrically-insulating material and may be required to withstand temperatures of up to 400° C. The support block can be made of a machinable ceramic, such as Macor, sintered from ceramic, such as polycrystalline alumina, ground from glass such as pyrex or fused silica, or molded or machined from a high temperature polymer such as Ultem. The refractory material should have good mechanical strength, be heat resistant, be nonmetallic and be formable. A preferred material is Macor, since it is easily machined. However, other materials may be used within the scope of the present invention.

In one preferred embodiment, the refractory block has a width of about 0.2 inch, a thickness of about 0.125 inch and a height of about 0.28 inch. The groove 70 has a width W of 0.07 inch and a depth D of about 0.063 inch. The support block is used to support a 35 watt lamp capsule having a 2 mm interior diameter by 10 mm interior length with a support tubulation attached colinearly with the lamp axis. The lamp stem has a 1 mm inside diameter, a 2 mm outside diameter and is about 12 mm long.

Figure 5:
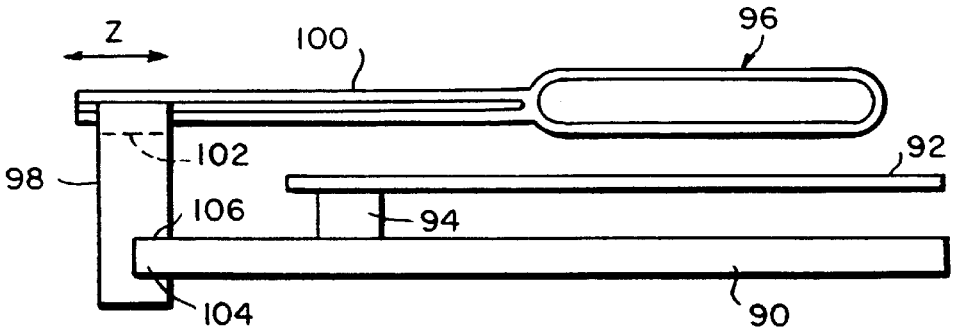
FIG. 5 is a schematic representation of a second embodiment of an electrodeless high-intensity discharge lamp in accordance with the present invention.

A second embodiment of an electrodeless lamp assembly in accordance with the invention is illustrated in FIG. 5. Electric field applicators have been omitted from FIG. 5 for simplicity of illustration. A transmission line includes a ground plane 90 and a microstrip line 92, each of which may be metal. The microstrip line 92 is spaced from ground plane 90 by an insulating support 94. An electrodeless lamp capsule 96 is positioned above microstrip line 92 by a refractory support block 98. A lamp stem 100 of lamp capsule 96 is cemented in a recess 102 in support block 98. An edge 104 of ground plane 92 is cemented in a groove 106 in support block 98. The support block 98 may have the construction shown in FIGS. 2 and 3 and described above.

Figure 6:
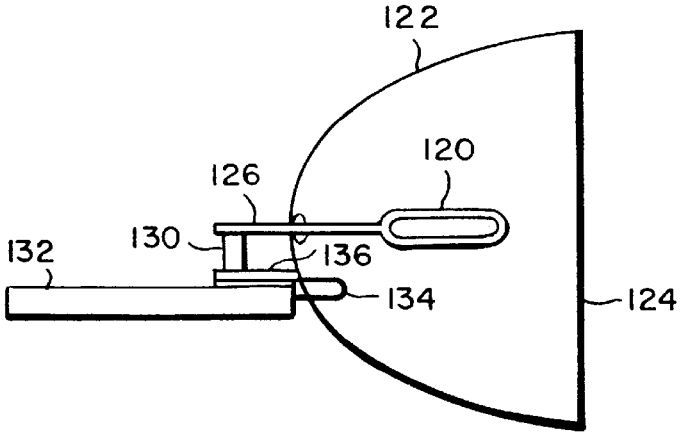
FIG. 6 is a schematic representation of a third embodiment of an electrodeless high intensity discharge lamp in accordance with the invention.

Yet another embodiment of the invention is illustrated in FIG. 6. An electrodeless lamp capsule 120 is positioned within a cavity defined by a reflector 122 and a wire mesh screen 124. A lamp stem 126 of lamp capsule 120 extends through reflector 122 to a support block 130. The lamp stem 126 is cemented in a recess in support block 130 as described above. Electrical energy is supplied to lamp capsule 120 by a coaxial transmission line 132 which terminates in a loop coupler 134. The support block 130 is secured to the edge of a substrate 136, which in turn is mounted to transmission line 132.

The electric field applicators 18 and 19 may comprise helical couplers as disclosed in the aforementioned U.S. Pat. No. 5,070,277; end cup applicators as disclosed in the aforementioned U.S. Pat. No. 5,241,246; loop applicators as disclosed in the aforementioned U.S. Pat. No. 5,130,612; or any other suitable electric field applicator. In general, the electric field applicators produce a high intensity electric field within the enclosed volume of the lamp capsule, so that the applied high frequency power is absorbed by the plasma discharge.

The high intensity discharge lamp of the present invention can operate at any frequency in the range of 13 megahertz to 20 gigahertz at which substantial power can be developed. The operating frequency is typically selected in one of the ISM bands. The frequencies centered around 915 megahertz and 2.45 gigahertz are particularly appropriate.

The planar transmission line 16 is designed to couple high frequency power at the operating frequency to the electric field applicators 18 and 19 with 180° phase shift. The design and construction of planar transmission lines for transmission of high frequency power are well known to those skilled in the art. The substrate 30 of the planar transmission line is a dielectric material, such as for example, glass, microfiber reinforced PTFE, composite laminate or BEO having an approximate relative dielectric constant of 2.5 to 10.0 and having a thickness of 0.030–0.062 inch. The conductor 34 is patterned on one surface of the substrate, and a ground plane conductor is formed on the opposite surface of the substrate. Examples of suitable planar transmission lines include stripline and microstripline transmission lines.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electrodeless lamp assembly comprising:

an electrodeless lamp capsule;

a substrate having top and bottom surfaces and an edge;

an applicator for coupling electrical energy to said lamp capsule; and a refractory support block comprising a top wall having a recess and a side wall having a groove, said lamp capsule being affixed in said recess and the edge of said substrate being secured in said groove, wherein said lamp capsule is supported above said substrate by said support block, said recess and said groove each having a longitudinal axis and wherein the longitudinal axis of said recess is perpendicular to the longitudinal axis of said groove.

2. An electrodeless lamp assembly as defined in claim 1 wherein said support block comprises a parallelepiped.

3. An electrodeless lamp assembly as defined in claim 2 wherein said recess comprises a V-shaped notch.

4. An electrodeless lamp assembly as defined in claim 2 wherein said recess comprises a semicircular notch.

5. An electrodeless lamp assembly as defined in claim 2 wherein said lamp capsule includes a lamp stem and wherein said recess is sized and shaped for receiving said lamp stem.

6. An electrodeless lamp assembly as defined in claim 1 wherein said support block is fabricated of a heat-resistant, nonmetallic material.

7. An electrodeless lamp assembly as defined in claim 1 wherein said support block comprises a rectangular parallelepiped.

8. An electrodeless lamp assembly as defined in claim 1 wherein said substrate is planar.

9. A refractory block for supporting a lamp capsule above a substrate, comprising a parallelepiped fabricated of a refractory material and having a top wall and plural side walls, said top wall having a recess for receiving the lamp capsule and one of said side walls having a groove for receiving an edge of the substrate, said recess and said groove each having a longitudinal axis and wherein the longitudinal axis of said recess is perpendicular to the longitudinal axis of said groove.

10. A refractory block as defined in claim 9 wherein said recess comprises a V-shaped notch.

11. A refractory block as defined in claim 9 wherein said recess comprises a semicircular notch.

12. A refractory block as defined in claim 9 fabricated of a heat-resistant, nonmetallic material.

13. A refractory block as defined in claim 9 wherein said groove has a rectangular cross section.

14. A refractory block as defined in claim 9 comprising a rectangular parallelepiped.

15. An electrodeless high intensity discharge lamp assembly comprising:

an electrodeless lamp capsule having an enclosed volume containing a mixture of starting gas and chemical dopant material excitable by high frequency power to a state of luminous emission;

a first electric field applicator and a second electric field applicator;

a transmission line comprising a substrate having a patterned conductor on a first surface for coupling high frequency power from an input to said first and second electric field applicators, and a ground plane on a second surface; and a refractory support block comprising a top wall having a recess and a side wall having a groove, said lamp capsule being affixed in said recess and the edge of said substrate being secured in said groove, wherein said lamp capsule is positioned by said support block between the first and second field applicators.

16. An electrodeless high intensity discharge lamp assembly as defined in claim 15 wherein said recess comprises a V-shaped notch.

17. An electrodeless high intensity discharge lamp assembly as defined in claim 15 wherein said recess comprises a semicircular notch.

18. An electrodeless high intensity discharge lamp assembly as defined in claim 15 wherein said recess and said groove each has a longitudinal axis and wherein the longitudinal axis of said recess is perpendicular to the longitudinal axis of said groove.

* * * * *